US012234720B2

(12) United States Patent
Muraikhi et al.

(10) Patent No.: US 12,234,720 B2
(45) Date of Patent: Feb. 25, 2025

(54) DIFFERENTIAL PRESSURE ACTIVATED INFLOW CONTROL DEVICE (ICD) INSTALLATION CONDITION VERIFICATION PRIOR TO RIG MOVE

(71) Applicant: SAUDI ARABIAN OIL COMPANY, Dhahran (SA)

(72) Inventors: Mubarak A. Muraikhi, Alkhobar (SA); Khalid M. Alhajri, Alkhobar (SA); Mohammad W. Alsaleh, Mubarraz (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/193,785

(22) Filed: Mar. 31, 2023

(65) Prior Publication Data

US 2024/0328305 A1 Oct. 3, 2024

(51) Int. Cl.
*E21B 47/11* (2012.01)
*E21B 21/10* (2006.01)

(52) U.S. Cl.
CPC ..... *E21B 47/11* (2020.05); *E21B 21/10* (2013.01)

(58) Field of Classification Search
None
See application file for complete search history.

(56) References Cited

U.S. PATENT DOCUMENTS

| | | | | |
|---|---|---|---|---|
| 5,458,197 | A * | 10/1995 | Chan | E21B 37/00 507/216 |
| 8,550,103 | B2 | 10/2013 | Chen et al. | |
| 8,833,154 | B2 | 9/2014 | Skillingstad | |
| 9,353,607 | B2 | 5/2016 | Hallundbæk et al. | |
| 10,669,810 | B2 | 6/2020 | Egbe et al. | |
| 2011/0239754 | A1* | 10/2011 | Dyer | E21B 47/11 73/152.18 |
| 2012/0325464 | A1* | 12/2012 | Kilaas | C09K 8/52 166/252.6 |
| 2015/0060059 | A1 | 3/2015 | Langlais et al. | |
| 2015/0308224 | A1 | 10/2015 | Dyer et al. | |
| 2016/0003017 | A1* | 1/2016 | Keller | E21B 43/162 166/250.1 |

OTHER PUBLICATIONS

D. Semikin et al.; "Autonomous ICD Well Perfomance Completed With Intelligent Inflow Tracer Technology in the Yuri Korchagin Field in Russia", SPE-176563-MS; Society of Petroleum Engineers; Oct. 2015; pp. 1-21 (21 pages).

(Continued)

*Primary Examiner* — Andrew Sue-Ako
(74) *Attorney, Agent, or Firm* — Osha Bergman Watanabe & Burton LLP

(57) ABSTRACT

A method includes installing a drilling rig at a surface of a well, filling each of one or more inflow control devices with one or more unique tracer chemicals, and installing the one or more inflow control devices in a wellbore of the well. The method also includes performing an opening procedure on the one or more inflow control devices and performing, using the drilling rig, a bottom-up circulation procedure. The method further includes collecting a volume of wellbore fluid at the surface and analyzing the volume of wellbore fluid to determine which unique tracer chemicals are present in the volume.

10 Claims, 4 Drawing Sheets

(56) References Cited

OTHER PUBLICATIONS

A. Montes et al.; "Application of Inflow Well Tracers for Permanent Reservoir Monitoring in North American Amethyst Subsea Tieback ICD wells in Canada", SPE 167463; Society of Petroleum Engineers; Oct. 2013; pp. 1-15 (15 pages).
T. Solovyev et al.; "Successful Application of the Intelligent Inflow Tracers for Monitoring of Horizontal Wells on North Komsomolskoe Field", SPE-196831-MS; Society of Petroleum Engineers; Oct. 2019; pp. 1-18 (18 pages).

* cited by examiner

DIFFERENTIAL PRESSURE ACTIVATED INFLOW CONTROL DEVICE (ICD) INSTALLATION CONDITION VERIFICATION PRIOR TO RIG MOVE

BACKGROUND

In the oil and gas industry, drilling is a crucial operation for ensuring the productivity of wells. There are a number of different types of completions which may be used. For example, well completions may include open hole completion, perforated liner completion, inflow control device (ICD) screen completion, and inflow control valve (ICV) completion. The completion type may vary and may be selected, for example, based on reservoir type or fluid produced budget. ICD screen completion is one of the most prevalently used completion types, with its main function being to control the water breakthrough to the well. Water breakthrough can kill or reduce the production potential of the well.

ICD completions have a number of potential problems. For example, in order for ICD completions to function as planned, the ICDs must open while installed in the wellbore. However, ensuring that the installed ICDs have opened is often costly, both in terms of monetary expenses and well downtime.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system. The system may include a wellbore extending from a surface location to a formation and a wellbore fluid disposed within the wellbore. The system may also include a drilling rig installed at the surface location and one or more inflow control devices, each inflow control device comprising one or more unique tracer chemicals.

In another aspect, embodiments disclosed herein relate to a method. The method may include installing a drilling rig at a surface of a well, filling each of one or more inflow control devices with one or more unique tracer chemicals, and installing the one or more inflow control devices in a wellbore of the well. The method may also include performing an opening procedure on the one or more inflow control devices and performing, using the drilling rig, a bottom-up circulation procedure. The method may further include collecting a volume of wellbore fluid at the surface and analyzing the volume of wellbore fluid to determine which unique tracer chemicals are present in the volume.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
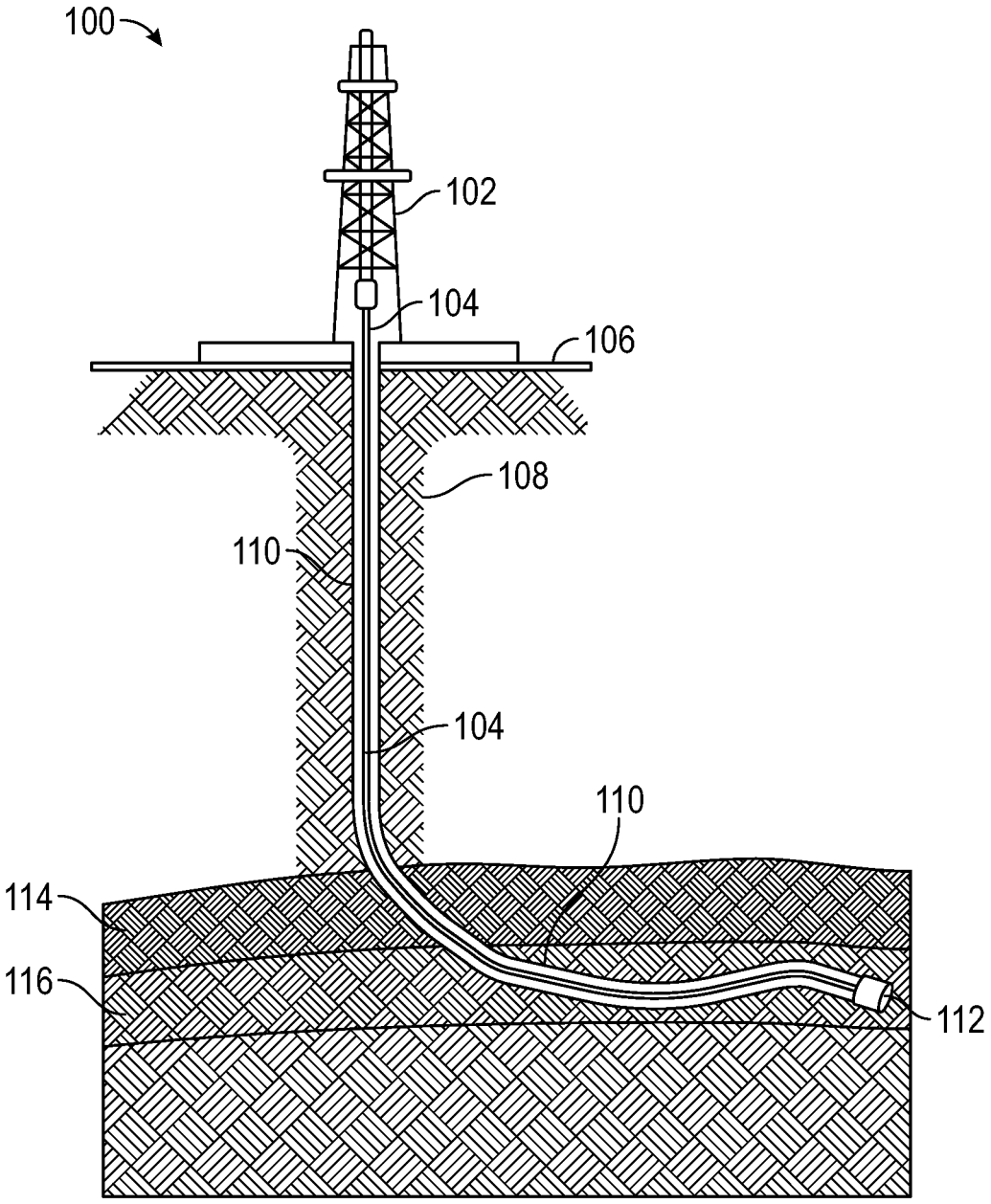
FIG. 1 shows an exemplary well system.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-4, any component described with regard to a figure, in various embodiments disclosed herein, may be equivalent to one or more like-named components described with regard to any other figure. For brevity, descriptions of these components may not be repeated for each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Further, embodiments disclosed herein are described with terms designating a rig site in reference to a land rig, but any terms designating rig type should not be deemed to limit the scope of the disclosure. For example, embodiments of the disclosure may be used on an offshore rig and various rig sites, such as land/drilling rig and drilling vessel. It is to be further understood that the various embodiments described herein may be used in various stages of a well, such as rig site preparation, drilling, completion, abandonment etc., and in other environments, such as work-over rigs, fracking installation, well-testing installation, and oil and gas production installation, without departing from the scope of the present disclosure. The embodiments are described merely as examples of useful applications, which are not limited to any specific details of the embodiments herein.

In one aspect, embodiments disclosed herein relate to methods and systems for use in determining if deployed inflow control devices (ICD) within a wellbore have successfully opened. Specifically, embodiments disclosed herein relate to a specialized inflow control device configured to contain a volume of a unique tracer chemical and to release the unique chemical tracer when the ICD opens according to operational needs.

FIG. 1 illustrates an exemplary well 100 in accordance with one or more embodiments. As shown in FIG. 1, a well path 110 may be drilled by a drill bit 112 attached by a drill string 104 to a drill rig 102 located on the surface of the earth 106. The well may traverse a plurality of overburden layers 108 and one or more cap-rock layers 114 to a hydrocarbon reservoir 116. The well path 110 may be a curved well path, or a straight well path. In one or more embodiments, the well path 110 may be described as vertical, deviated, horizontal, or extended reach drilling (ERD). One skilled in the art will be aware that deviated, horizontal, and ERD wells are considered to be complex.

Figure 2:
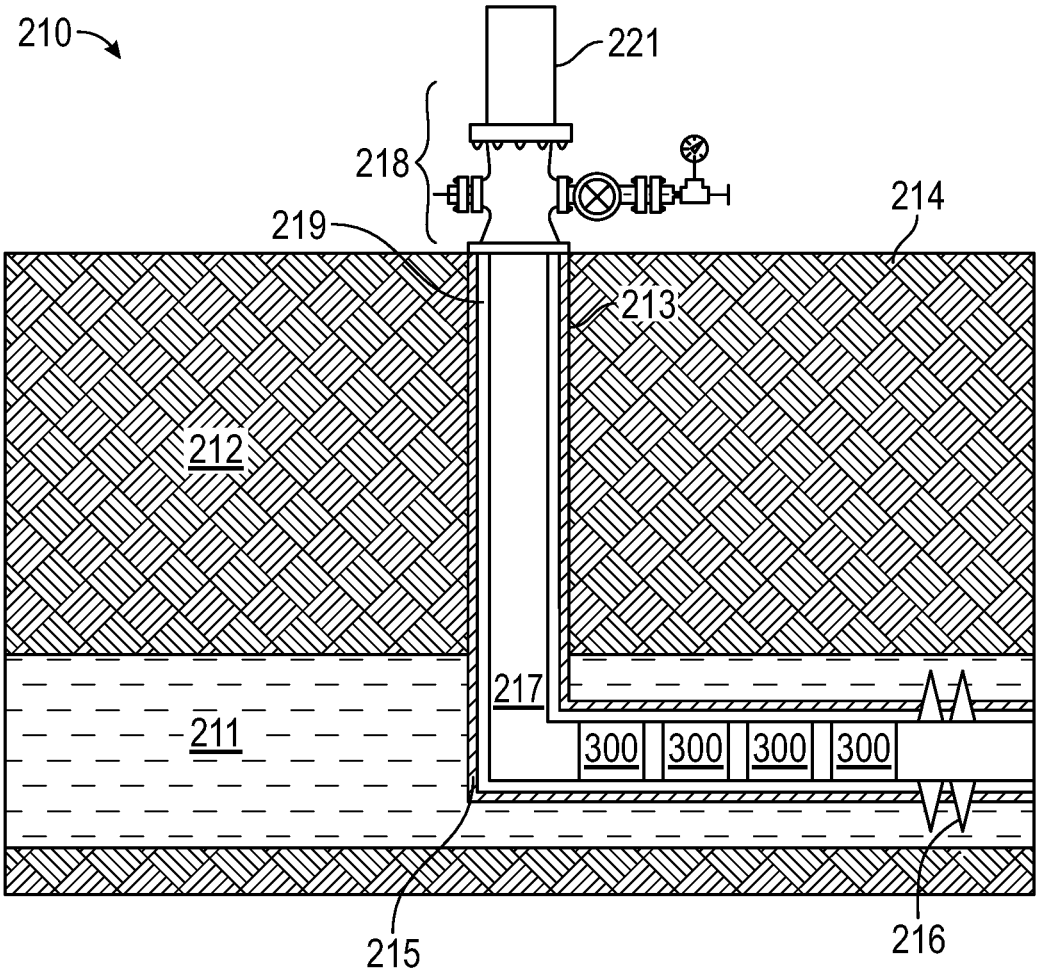
FIG. 2 shows a conventional completion well site.

Turning to FIG. 2, in one or more embodiments, an example of a completion well site 210 is illustrated. Well fluids are produced from a reservoir 211 in a formation 212 by drilling a wellbore 213 into the formation 212, establishing a flow path between the reservoir 211 and the wellbore 213, and conveying the fluids from the reservoir 211 to a surface 214 through the wellbore 213. Additionally, the wellbore 213 may include a vertical section to reach the reservoir 211 and a horizontal section extending into the reservoir 211. A casing 215 may be installed in the wellbore 213. In some embodiments, the casing 215 may be perforated to have perforations 216 into the reservoir 211 to allow a flow of the well fluids to enter the wellbore 213. Typically, a production tubing 217 is disposed in the wellbore 213 to carry the fluids to the surface 214. The production tubing 217 hangs from a wellhead 218 at the surface 214 and forms an annulus 219 between the production tubing 217 and the wellbore 213. The production tubing 217 may extend horizontally into the reservoir 211, thereby forming a flow conduit from the reservoir 211 to surface 214. From the wellhead 218, the fluids are transported, via a production flow line, to a production storage, transport, or facility. In some embodiments, a Christmas tree may be disposed on top of the wellhead 218 for fluid transportation.

As well fluids are produced from the reservoir 211, the well fluids flow into the annulus 219. As the well fluids may contain water, a ratio of hydrocarbons (e.g., oil and/or gas) to water may vary throughout the lifetime of the well. To control an influx of water, one or more inflow control devices 300 may be provided in the production tubing 217. As the well fluids flow in the annulus 219, the produced well fluids may flow from the annulus 219 and into the production tubing 217 via the one or more inflow control devices 300.

In one or more embodiments, the completion well site 210 may also include a collection and analysis system 221 installed at the surface 214. The collection and analysis system 221 may be configured to collect a volume of the wellbore fluid from the wellbore 213 and to analyze the wellbore fluid.

Figure 3:
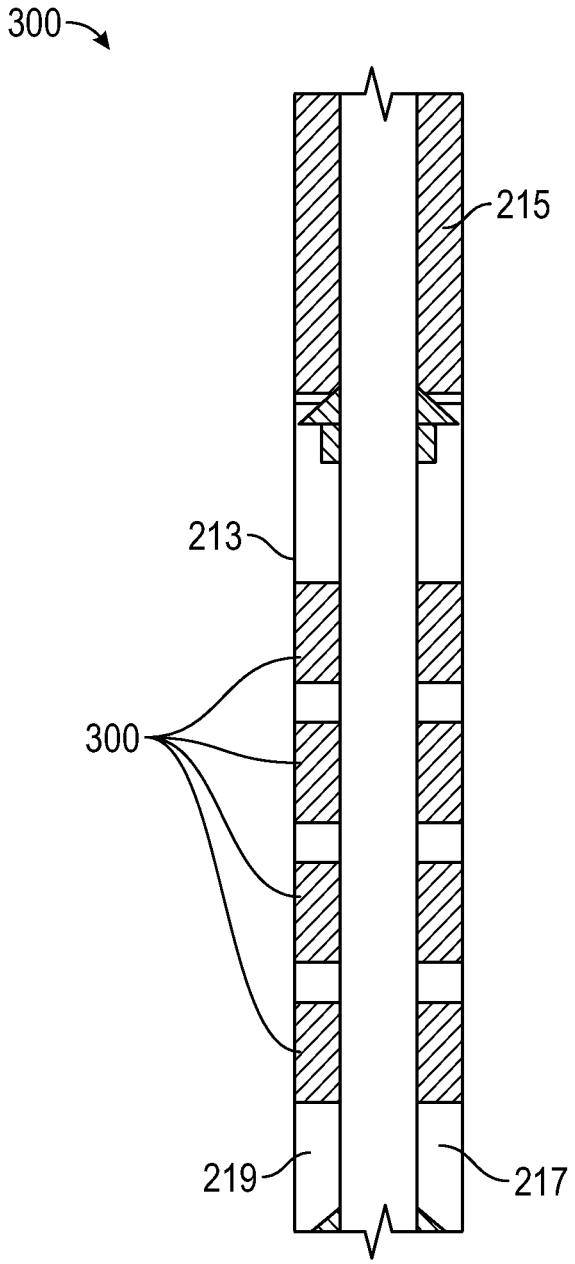
FIG. 3 shows a wellbore with an inflow control device completion in accordance with one or more embodiments.

Turning now to FIG. 3, FIG. 3 shows a wellbore 213 with an inflow control device completion in accordance with one or more embodiments. One or more inflow control devices (ICDs) 300 may be installed along the length of the wellbore 213. In accordance with routine operations, each ICD 300 may open when deployed within the wellbore 213. Each ICD 300 may be designed to contain a volume of a unique tracer chemical when it is deployed in a closed configuration, such that each ICD 300 contains a different tracer chemical than the other ICDs 300.

The ICDs 300 may be opened when the rig conducts an ICD opening procedure. Once opened, each ICD 300 may be configured to release one or more unique tracer chemicals into the wellbore fluid. The rig may perform a bottom-up circulation, where wellbore fluid, and any released unique tracer chemicals, are displaced to the surface 214. A volume of the displaced fluids may then be collected and analyzed using a collection and analysis system 221, shown in FIG. 2. The collection and analysis system 221 may be configured to determine which unique tracer chemicals are present in the displaced fluid and, as a result, which unique tracer chemicals are missing. This may allow for the determination of which, if any, of the ICDs 300 did not open as intended.

Figure 4:
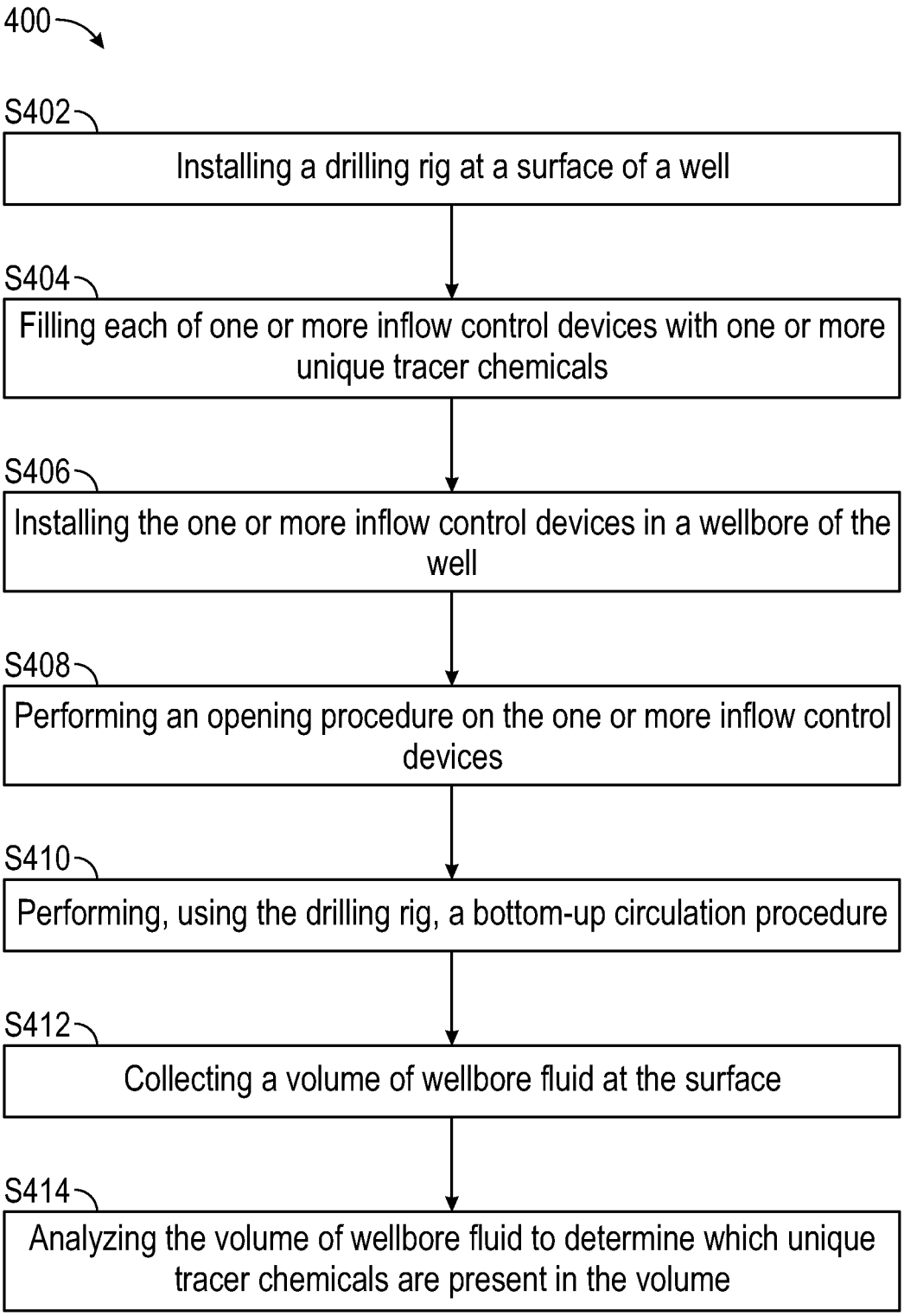
FIG. 4 shows a flowchart of a method in accordance with one or more embodiments.

FIG. 4 depicts a flowchart in accordance with one or more embodiments. More specifically, FIG. 4 depicts a flowchart 400 of a method of determining successful functionality of one or more inflow control devices according to embodiments of the present disclosure. Further, one or more blocks in FIG. 4 may be performed by one or more components as described in FIGS. 1-3. While the various blocks in FIG. 4 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, a drilling rig may be installed at a surface 214 of a well 100, S402. One or more inflow control devices (ICDs) 300 may be provided at the surface 214. Each of the one or more ICDs 300 may be filled with one or more unique tracer chemicals, S404. The one or more tracer chemicals may be, for example, any chemical which does not dissolve or otherwise react with oil or water. Further, each of the one or more unique tracer chemicals may be designed on a case-by-case basis depending on field conditions (e.g., pressure or temperature).

The one or more ICDs 300 may be installed in a wellbore 213 of the well 100, S406. In one or more embodiments, the ICDs 300 may be spaced along the length of the wellbore 213, as shown in FIG. 3. The ICDs 300 may be installed, for example, to control a water breakthrough to the wellbore 213. An opening procedure may be performed on the ICDs 300, S408. An opening procedure, for example, may preferably include creating a differential pressure across each of the ICDs 300 such that each of the ICDs 300 opens without mechanical intervention. In one or more embodiments, performing an opening procedure may include releasing the unique tracer chemicals from the one or more ICDs 300, such that the unique tracer chemicals may communicate with the wellbore fluid.

A bottom-up circulation procedure may be performed using the drilling rig, S410. In one or more embodiments, performing a bottom-up circulation procedure may include displacing wellbore fluid from the wellbore 213. The wellbore fluid may be, for example, drilling mud. In one or more embodiments, the wellbore fluid may include each of the unique tracer chemicals released from the one or more ICDs 300. A volume of wellbore fluid may be collected at the surface 214, S412. In one or more embodiments, the volume of wellbore fluid may be collected by a collection and analysis system 221 installed at the surface 214. Once collected, the volume of wellbore fluid may be analyzed to determine which unique tracer chemicals are present in the volume, S414.

In one or more embodiments, the method may further include detecting which unique tracer chemicals are absent from the volume of wellbore fluid. As a result, it may be possible to identify which of the ICDs 300 did not open as intended. In response, a remedial action plan may be performed. A remedial action plan, for example, may include applying another differential pressure across the unopened ICDs by displacing fluid from the wellbore 213. A further step of the remedial action plan may include mechanically opening any unopened ICDs 300 using an ICD shifting tool, which may be run-in-hole.

Embodiments of the present disclosure may provide at least one of the following advantages. In commercially available systems, it is often difficult to ensure that ICDs installed within a wellbore have opened as intended. The opening of the ICDs is critical to controlling water breakthrough to the wellbore, which can kill or reduce production potential of the well. Currently available systems for checking ICD status involve mechanical intervention post rig operation or after flowing the well. Both of these options necessarily require large time losses, which are expensive and lead to unplanned production rate reductions. Embodiments of the present disclosure allow for confirmation that installed ICDs have opened according to the operational plan. Further, embodiments of the present disclosure allow for a remedial action plan to be implemented to ensure all ICDs are open. Implementation of the embodiments described herein removes the need for the running in hole of mechanical tools to check each ICD individually. Further, a dramatic reduction in well downtime (in comparison to currently available systems) may be achieved.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system comprising:

a wellbore extending from a surface location to a formation;

a wellbore fluid disposed within the wellbore, wherein the wellbore fluid comprises drilling mud;

a drilling rig installed at the surface location;

one or more differential pressure activated inflow control devices configured to release one or more unique tracer chemicals into the wellbore fluid following application of a differential pressure across each inflow control device by displacing wellbore fluid from the wellbore; and a collection and analysis system installed at the surface location, the collection and analysis system configured to:

collect a volume of the wellbore fluid from the wellbore;

detect an absence of unique tracer chemicals in the volume of the wellbore fluid; and determine which of the one or more differential pressure activated inflow control devices did not open by identifying which of the unique tracer chemicals is not present in the wellbore fluid, wherein the one or more differential pressure activated inflow control devices that did not open are opened by an application of differential pressure by a displacement of fluid from the wellbore.

2. The system of claim 1, wherein the one or more differential pressure activated inflow control devices are configured to open after installation of the drilling rig.

3. The system of claim 2, wherein each differential pressure activated inflow control device is configured to release the unique tracer chemicals after the differential pressure activated inflow control device has opened.

4. The system of claim 3, wherein the unique tracer chemicals communicate with the wellbore fluid when each of the differential pressure activated inflow control devices are in an open configuration.

5. The system of claim 1, wherein the drilling rig is configured to induce a bottom-up circulation procedure to displace the wellbore fluid from the wellbore.

6. The system of claim 1, wherein the one or more inflow control devices are configured to control a water breakthrough to the wellbore.

7. A method, comprising:

installing a drilling rig at a surface of a well;

filling each of one or more differential pressure activated inflow control devices with one or more unique tracer chemicals;

installing the one or more differential pressure activated inflow control devices in a wellbore of the well;

performing an opening procedure on the one or more differential pressure activated inflow control devices, wherein the opening procedure comprises applying a first differential pressure across each of the differential pressure activated inflow control devices such that at least one of the differential pressure activated inflow control devices opens without mechanical intervention;

performing, using the drilling rig, a bottom-up circulation procedure;

collecting a volume of wellbore fluid at the surface, wherein the wellbore fluid comprises drilling mud;

analyzing the volume of wellbore fluid to determine which unique tracer chemicals are present in the volume;

detecting an absence of unique tracer chemicals in the volume of wellbore fluid;

determining which of the one or more differential pressure activated inflow control devices did not open; and applying a second differential pressure across unopened differential pressure activated inflow control devices by displacing wellbore fluid from the wellbore.

8. The method of claim 7, wherein performing a bottom-up circulation procedure comprises displacing wellbore fluid from the wellbore.

9. The method of claim 7, further comprising controlling a water breakthrough to the wellbore using the one or more differential pressure activated inflow control devices.

10. The method of claim 7, wherein performing an opening procedure on the one or more differential pressure activated inflow control devices comprises releasing the unique tracer chemicals from the one or more differential pressure activated inflow control devices.

* * * * *